United States Patent [19]

Watabe

[11] 4,212,565

[45] Jul. 15, 1980

[54] METHOD AND APPARATUS FOR FORMING A CONTINUOUS ROW OF CAST-IN-PLACE PILES TO FORM A WALL

[75] Inventor: Keiichi Watabe, Matsudo, Japan

[73] Assignee: The Shimizu Construction Co., Ltd., Japan

[21] Appl. No.: 936,488

[22] Filed: Aug. 24, 1978

[30] Foreign Application Priority Data

Apr. 17, 1978 [JP] Japan ..... 53-45106

[51] Int. Cl.[2] ..... E02D 5/34

[52] U.S. Cl. ..... 405/269; 405/267; 175/67; 175/215

[58] Field of Search ..... 405/267, 262, 241, 303, 405/232, 269, 236, 242, 243, 244, 50, 238, 237; 175/67, 215

[56] References Cited

U.S. PATENT DOCUMENTS

| | | | |
|---|---|---|---|
| 3,023,585 | 3/1962 | Liver | 405/269 |
| 3,274,782 | 9/1966 | Landau | 405/50 |
| 3,604,214 | 9/1971 | Turzillo | 405/241 |
| 4,084,648 | 4/1978 | Yahiro | 405/267 |

FOREIGN PATENT DOCUMENTS

| | | | |
|---|---|---|---|
| 50-28118 | 3/1975 | Japan | 405/267 |
| 1441473 | 6/1976 | United Kingdom | 405/267 |
| 361252 | 1/1973 | U.S.S.R. | 405/267 |

*Primary Examiner*—Roy D. Frazier
*Assistant Examiner*—Alexander Grosz
*Attorney, Agent, or Firm*—Lerner, David, Littenberg & Samuel

[57] ABSTRACT

A method and apparatus is provided for forming a row of piles to form a wall by employing an earth auger device. The method comprises the steps of drilling an intermediate hole in the earth with the auger between two previously-formed and spaced-apart piles, then stopping rotation of the earth auger at the bottom of the intermediate hole after completion of the drilling operation, pouring in mortar while pulling out the auger to form an intermediate pile between the previously-formed piles and, at the same time, cutting away or displacing portions of earth between the previously-formed piles and the intermediate pile, and replacing the displaced earth with pile-forming mortar to integrally join the intermediate pile with the previously-formed piles. The earth auger device comprises a hollow auger shaft, with a series of spiral vanes on its exterior and with low- and high-pressure pipe lines disposed in the shaft for supplying mortar under low pressure through a port at the lower end thereof, and for supplying mortar under high pressure through jet nozzles embedded in the lowermost vane.

5 Claims, 10 Drawing Figures

METHOD AND APPARATUS FOR FORMING A CONTINUOUS ROW OF CAST-IN-PLACE PILES TO FORM A WALL

BACKGROUND OF THE INVENTION

1. Field of the Invention

The present invention relates to a method of forming a row of piles to form a wall, such as a retaining wall, for underground excavation by applying continuous packed-in-place mortar to form the pile, and by employing an earth auger device for use in the method.

2. Description of the Prior Art

In the prior art, to form piles, pile holes are excavated by an earth auger, and mortar is poured into the pile holes from the lower tip of the auger while it is being pulled out of the hole. This process is referred to as forming packed-in-place piles. This operation is repeatedly carried out to form a row of piles to form a wall and is extensively employed because of minimal noises and vibrations at the time of execution and because of its workability and economy.

The above-mentioned row of individual piles, in which a number of piles are joined with one another to form a retaining wall, poses a problem with respect to providing a watertight arrangement. To overcome this, attempts have been made to provide a watertight connection between the piles. The process considered most effective includes forming an intermediate pile between two previously-formed and spaced-apart outer piles, then injecting mortar from inside of the intermediate pile towards the outer piles, and then the earth between the outer piles and the intermediate pile is removed to form a hollow channel into which pile-forming mortar flows to form wing-shaped extensions to connect all the piles.

With respect to this process, several modifications have been proposed in the prior art. However, these processes have certain disadvantages, including difficulty in forming good watertight wings. For example, in Japanese Patent Publication No. 16,534/1973, an intermediate hole is excavated between previously-installed and spaced-apart concrete foundation piles driven into the ground, with the center of the intermediate hole being displaced outwardly from a line joining the centers of the previously-installed foundation piles. Then, a water-injecting excavation device is inserted into the intermediate hole to inject muddy water through a water-injection nozzle thereof towards the foundation piles to remove earth and sand between the intermediate hole and the foundation piles so that a communication channel is formed. Thereafter, the foundation piles are washed, and mortar is poured into the intermediate hole and the communication channel to form a sheathing body which is watertight and connects the foundation piles with each other. In this process, the excavation of the center hole and the pouring of mortar requires two separate steps. In addition, since bentonite muddy water is used to excavate the intermediate hole and to remove earth and sand, it is necessary to wash the foundation piles in order to provide a watertight connection between the foundation piles and the sheathing. However, because of the presence of water, the quality of the pile-forming mortar is decreased. In addition, a large quantity of water and work is required because the washing step must be carefully accomplished not to cause damage to the holes before the pouring step.

In addition, in Japanese Patent Laid-open No. 28,118/1975, which is an application by the same assignee as the present invention, an advance over the above-mentioned prior art is provided, in that washing of the foundation piles after excavation of an intermediate hole is not required. However, mortar is poured through an auger tip into a hole excavated between foundation piles, and thereafter, with a separate system of injection, cement paste is jetted from inside of the pile-forming mortar towards the preceding piles to cut away and remove earth between the intermediate hole and the foundation piles, and the thus-removed earth is replaced by a cement composition. The removal of earth by the injection of cement paste and the replacement thereof with the cement composition must be completed while the mortar poured into the intermediate hole is green enough to allow it to flow towards preceding piles, and consequently, a time constraint is imposed on this two-step operation. However, in this method, complete replacement of the earth and sand with the cement composition is difficult, and there is no assurance that a complete watertight connection has been provided.

In another prior art arrangement disclosed in Japanese Patent Publication No. 7526/1978, there is provided an arrangement wherein an earth auger or the like is used to drill, and a jet nozzle at the lower tip thereof injects grouting chemicals into neighbouring earth and/or preceding piles while rotating the auger and upwardly pulling out the earth auger. The chemicals penetrate and solidify the portions of surrounding earth around the intermediate pile in a radial formation, thereby forming a grouted soil sheathing body between the piles. In this arrangement, the auger has a jet nozzle extended from the shaft between flights of screws, and hence, the jet nozzle tends to become clogged with the excavated earth, and in some cases, stones or the like hit the nozzle to damage it during the excavation. Accordingly, this arrangement is rather impractical.

SUMMARY OF THE INVENTION

The present invention provides an arrangement wherein mortar is jetted towards previously-formed piles while an intermediate pile is being formed to thereby form a sheathing wing wall or watertight connecting wall between the piles. This is similar to the prior art discussed above. However, in the present invention, pouring of the mortar into the intermediate pile is accomplished at the same rate as the jet cutting of earth by mortar between the intermediate pile and preceding piles, and in addition, the jetting of mortar is accomplished from the bottommost end of the auger. As a result, earth of desired thickness between the intermediate pile and preceding piles is displaced as mortar pile is formed, and at the same time, the earth is replaced with pile-forming mortar to form a sheathing wing wall or connecting wall between the preceding piles and the intermediate pile so as to provide a watertight connection between all the piles.

Moreover, in accordance with the present invention, during the step of upwardly pulling out the earth auger, the earth auger is moved up and down while pouring mortar from the auger head to thereby positively provide a watertight coating on the surface of the drilled hole by the mixture of mortar and earth in it and replacement of mortar between the preceding piles.

Other features and advantages of the invention will be apparent from the following detailed description taken in connection with the accompanying drawing.

DESCRIPTION OF THE PREFERRED EMBODIMENTS

Figure 1:
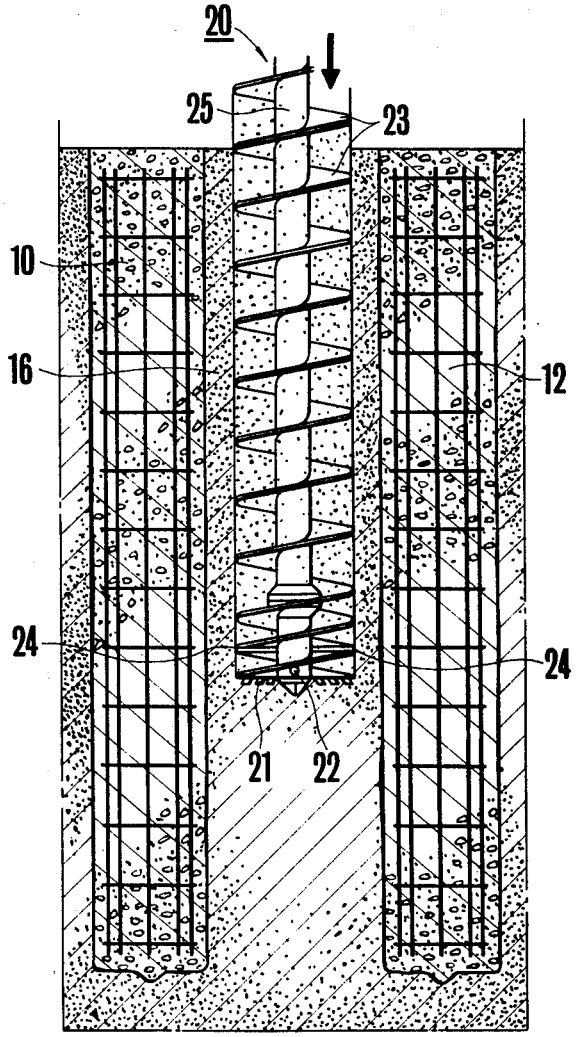
FIGS. 1 and 2 show a process of forming a sheathing wing wall in a row of packed-in-place piles and an earth auger device in accordance with the present invention.

First, as shown in FIG. 1, packed-in-place piles 10 and 12 with reinforcing bars placed therein are shown installed along the desired execution line and are in spaced relation to each other, as in prior art processes.

Figure 2:
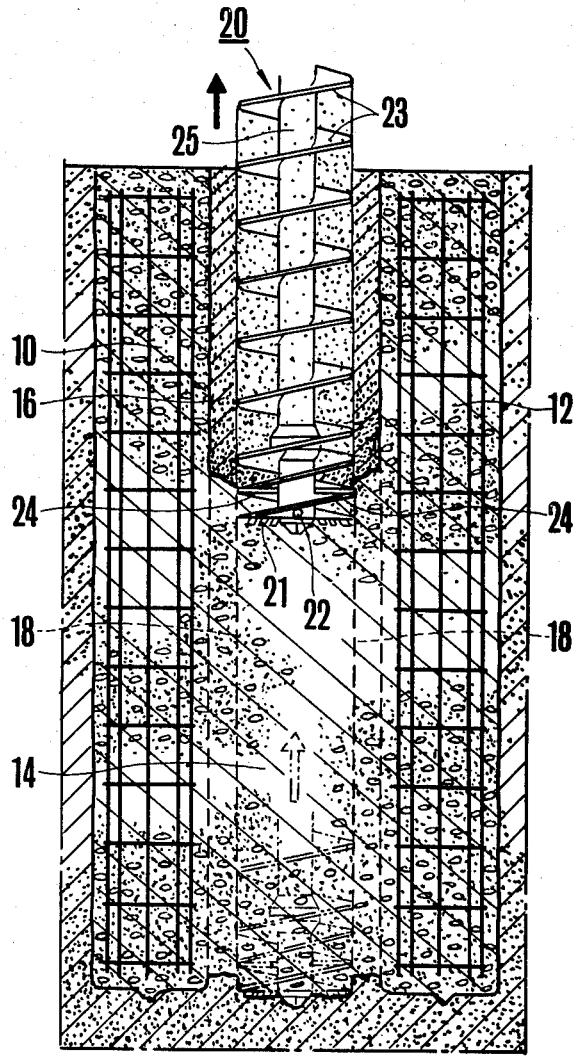

As shown in FIG. 1, an earth auger 20 is used to drill an intermediate hole in the earth between the preceding piles 10 and 12. Then, as shown in FIG. 2, mortar is poured into the excavated intermediate hole while upwardly pulling out the earth auger 20 to form an intermediate pile 14. The earth auger 20 used here, which is different from that of known types, has an auger head 21 formed with a mortar-pouring port 22 through which mortar for a pile is poured under low pressure, and also has auger head portions in a screw 23 provided with jet nozzles 24 through which mortar is jetted out under high pressure.

FIGS. 5 to 8 illustrate in detail the construction of the earth auger 20. A hollow auger shaft 25 is provided with a series of spiral screws or vanes 23 on the periphery thereof and is watertightly connected through a coupling 103 to the lower end of a driving shaft 26 rotatably mounted in the central portion of a frame 101 through a bearing 102. The driving shaft 26 has a driving gear 104 supported on the periphery thereof, with the driving gear 104 being meshed with gears 106 of variable speed geared motors 105, 105, and with electromagnetic brakes disposed in two locations on the frame 101 so that the driving shaft 26 may rotate along with the auger shaft 25 and a rotary shaft 28 within a water swivel 27 connected to the upper end of the driving shaft 26.

The lower end of the auger shaft 25 forms an auger head 21 watertightly connected through a flange coupling 31. The shaft **25*a* has a pair of screws 23*a*, which are provided with excavating blades 25*b* extended from the lowermost end edges thereof and disposed alternately in the periphery thereof. Each screw 23*a* is connected to the upper screw 23, and a pair of jet nozzles 24 is horizontally embedded on opposite ends of a joint 23*c* between both the screws 23 and 23*a* so that mortar is jetted under high pressure from opposite edges of the screws 23 and 23*a*** towards the wall of the drilled hole.

Figure 5:
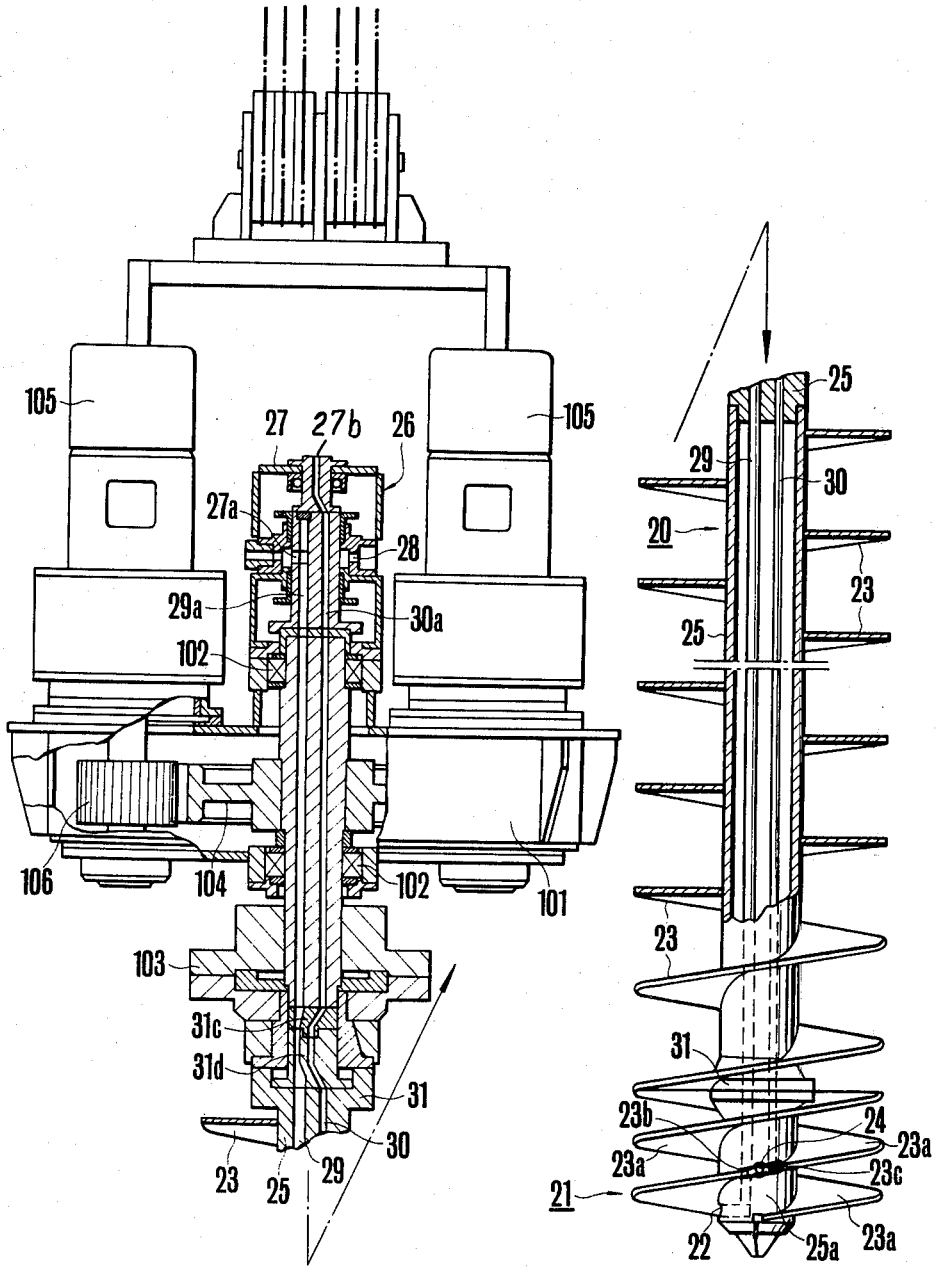
FIG. 5 is a front view, partially in longitudinal section, of the earth auger device.
Figure 6:
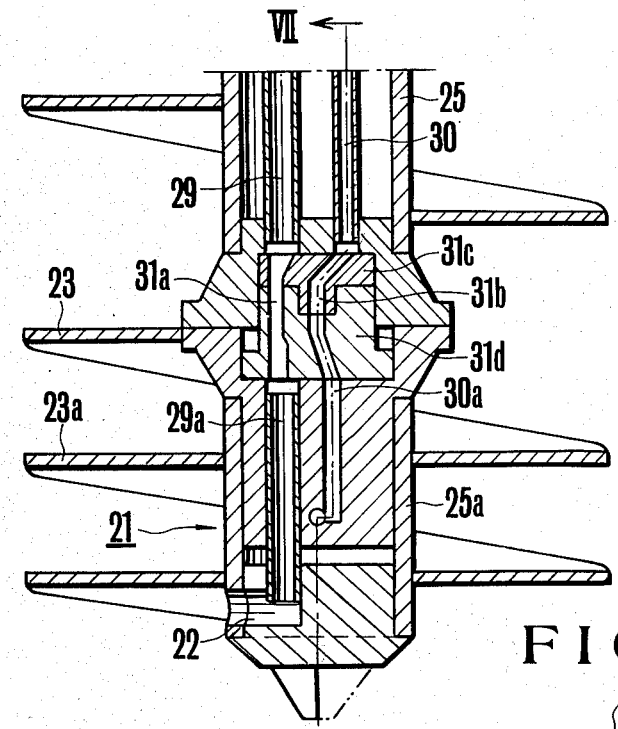
FIG. 6 is a longitudinal sectional view schematically illustrating an auger head.
Figure 7:
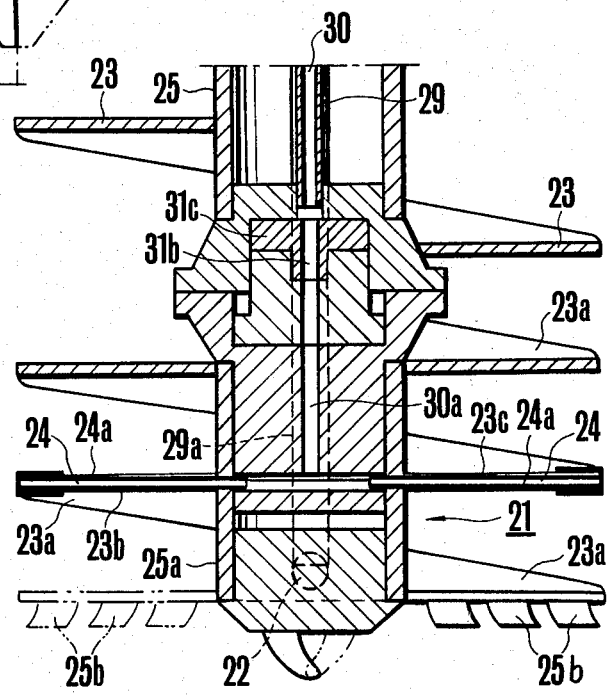
FIG. 7 is a cross-sectional view in the line of VII—VII of FIG. 6.
Figure 8:
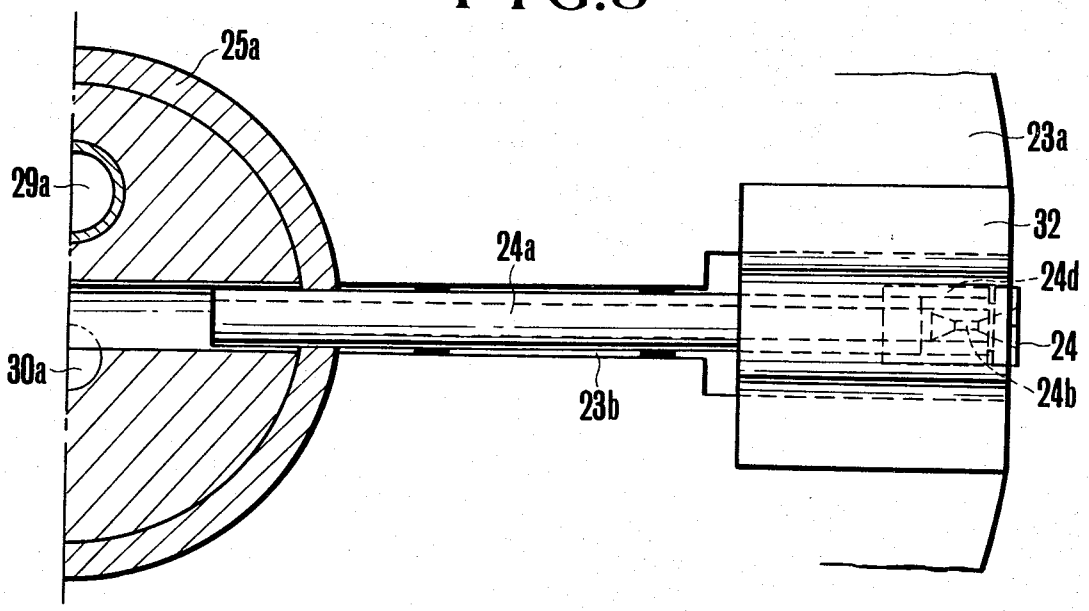
FIG. 8 is a plan view of a portion in which a jet nozzle is embedded.
Figure 9:
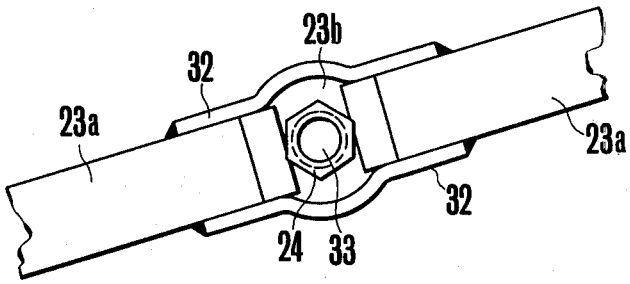
FIG. 9 is a front view of a jet nozzle portion.
Figure 10:
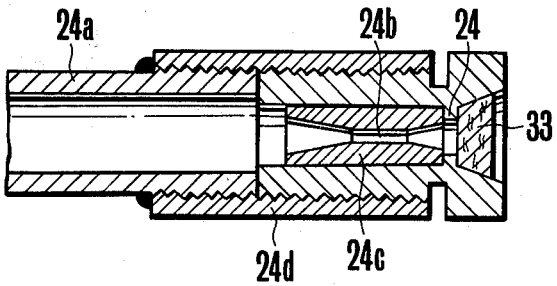
FIG. 10 is an enlarged sectional view of a jet nozzle.

The jet nozzles 24, 24 and the mortar-pouring port 22, formed in the auger head shaft **25*a*, are supplied with mortar under pressure separately through a low-pressure mortar pipe line 29 and a high-pressure mortar pipe line 30, respectively, disposed internally of the auger shaft 25, as shown in FIGS. 5 and 6. These lines 29 and 30 respectively communicate with the driving shaft 26 at the upper end of the auger shaft 25 and passages 29*a* and 30*a* within the auger head at the lower end thereof through a set of joints 31*c* and 31*d* having two flow passages 31*a* and 31*b* within the coupling, and also communicate with passages 29*a* and 30*a* formed internally of the rotary shaft 28 of the water swivel 27. The low-pressure mortar is fed under pressure from the passage 27*a* on the side of the water swivel into the auger head 21, and at the same time, the high-pressure mortar is fed under pressure from the passage 27*b* in the central portion at the top into the auger head 21. The low-pressure mortar is poured into the excavated hole by opening a valve disposed at the pouring port 22, whereas the high-pressure mortar is fed under pressure from a nozzle pipe 24*a*, connected at a right angle to the line 30, 30*a*. Nozzle pipe 24*a* is welded to the joint 23*b* between screws 23*a* and embedded at the outermost end with a cover 32, as shown in FIGS. 6 and 7. Each jet nozzle 24 is threaded into a socket 24*d* at the outermost end to be positioned at the screw edge, whereby mortar is jetted in opposite directions towards the preceding piles from the oppositely-disposed jet nozzles 24. Nozzles 24 are internally provided with a nozzle tip 24*c* and with a nozzle orifice formed by the provision of a restricted portion 24*b*, as shown in FIG. 9, and blowing off a plug 33**, such as a cork installed beforehand.

Then, after earth drilling has been completed by the use of the earth auger 20, its rotation is stopped, and the jet nozzles 24 are redirected towards the preceding piles 10 and 12. Mortar is then poured from port 22 and injected from jet nozzles 24 while upwardly pulling out the earth auger 20 to form the intermediate 14. Earth 16, which remains between the preceding piles 10 and 12 and intermediate pile 14, is cut into and displaced, and a channel is formed on each side of the intermediate pile. The earth 16 is displaced by the jet pressure of the mortar, and at the same time, the earth is replaced by the jetted mortar flowing into the channel to form watertight sheathing wing walls 18 of the desired width to integrally join all of the piles 10, 12, and 14. (See FIGS. 3 and 4.)

In order to prevent the water content of the mortar from being absorbed into the soil from the drilled hole, which would cause the insertion of reinforcing bars to become difficult, and in order to secure the formation of the sheathing wings 18 by the jet of mortar, the upward pulling out of the earth auger 20 may be accomplished while repeatedly moving the auger up and down to form a seepage preventive coating on the surface of the drilled intermediate hole while pouring the mortar. As a consequence, the earth in the drilled hole and mortar are blended by the screws 23 and **23*a***, and the earth removed by the jet is mixed into the mortar, thus being possible to disregard the influence of the remaining earth debris in the piles.

Figure 3:
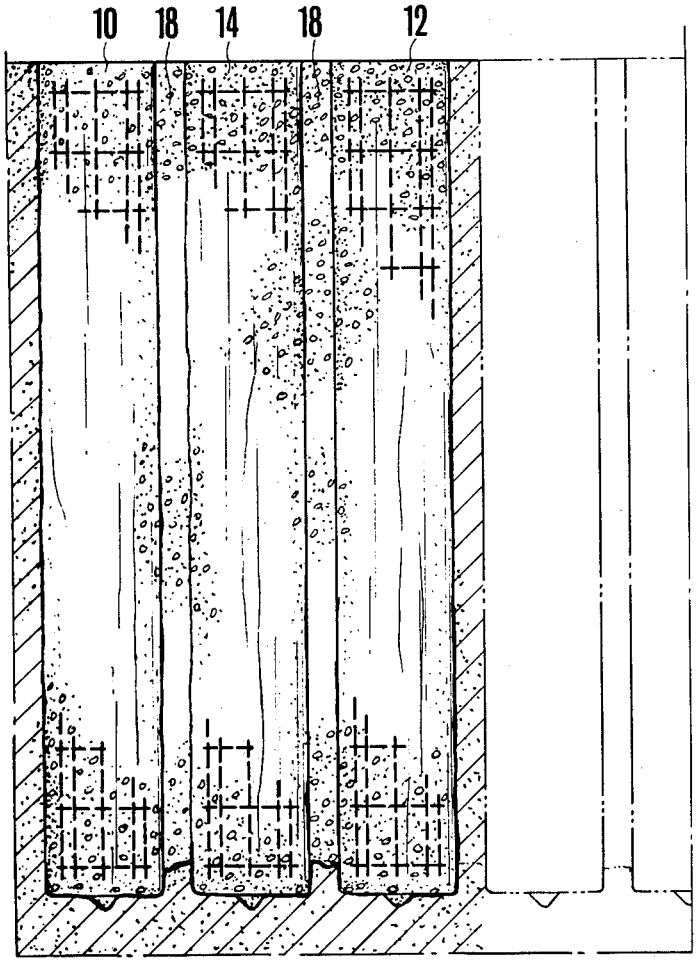
FIGS. 3 and 4 are a front view and a plan view, respectively, of a wall in the row of piles.
Figure 4:
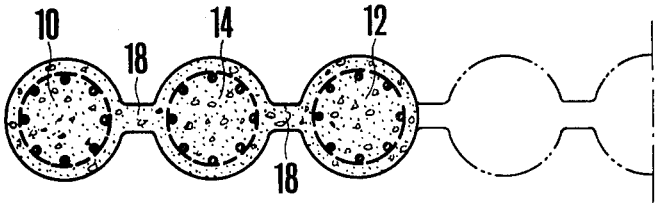

FIGS. 3 and 4 show a retaining wall comprising a row of mortar piles formed by repetitious operation of the aforementioned process, wherein a portion between the preceding piles 10 and 12 and the intermediate pile 14 is filled with the sheathing wing walls 18 to provide watertightness between the piles from each other, thus preventing seepage of water.

As described above, in accordance with the present invention, the portion of earth between the preformed piles 10 and 12 is drilled to form an intermediate hole, after which mortar for piles is poured into the intermediate hole under low pressure from the auger head to form an intermediate pile, and at the same time, mortar is jetted from the screw edge, in the periphery of the auger shaft, towards the preceding piles so that the earth between the preceding piles and the intermediate pile is replaced by the jetted mortar to form the sheathing wing walls 18 to integrally join all of the piles 10, 12, and 14. Accordingly, as a result of the present invention, washing of piles is avoided, and in addition, formation of the sheathing wall may be achieved more positively and accurately than is accomplished by the prior art processes of forming a sheathing wall after mortar is poured into the intermediate hole, or by the use of an earth auger with a jet nozzle extended from an auger shaft, and involves no time limit in formation of the sheathing wall. In addition, reinforcing bars may be also inserted easily into the intermediate pile, like the preceding piles. Furthermore, since the jet nozzle is embedded in the screw, the nozzle is prevented from being broken at the time of drilling, and the nozzle orifice may be located nearest to the preceding piles, thus minimizing any jet energy loss so that the sheathing wing wall of predetermined thickness may be formed to reach and connect the preceding piles of the wall.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. An earth auger device comprising an auger head and a hollow auger shaft rotatably connected to a driving unit, with a water swivel means connected to the upper end of the auger shaft, said auger shaft including a low-pressure mortar pipe line and a high-pressure mortar pipe line disposed therein, said lines extending through the hollow auger shaft into said auger head, said low-pressure line being connected to a pouring port in said auger head for pouring mortar into an excavated hole to form an intermediate pile, said high-pressure line being connected to jet nozzles mounted in said auger head for injecting mortar toward previously-formed piles to displace earth and to form walls connecting said intermediate pile with said previously-formed piles.

2. A device as claimed in claim 1, wherein said auger head includes a pair of screws having excavating blades disposed at the lower end thereof, and a pair of said jet nozzles being disposed on opposite sides of said auger head.

3. A device as claimed in claim 1, wherein said driving unit to rotate the auger shaft is disposed at two locations, and includes a driving shaft connected to the auger shaft.

4. A device as claimed in claim 1, wherein said low-pressure mortar pipe line within the auger shaft communicates with a passage on the side of the water swivel, and the high-pressure mortar pipe line communicates with a passage at the top of the water swivel in said driving unit.

5. A device as claimed in claim 1, wherein said low-pressure mortar pipe line and said high-pressure mortar pipe line are in communication with the rotating auger shaft in said driving unit and the respective passages in said auger head.

* * * * *